US005142977A

United States Patent [19]

Gertsch et al.

[11] Patent Number: 5,142,977

[45] Date of Patent: Sep. 1, 1992

[54] DEVICE TO ENGAGE, DISENGAGE AND ADJUST THE INKING ROLLERS OR WETTING ROLLERS OF A PRINTING PRESS

[75] Inventors: Peter Gertsch, Niederscherli; Robert Imhof, Bern; Andreas Miescher, Ittigen; Raffaele Faiazza, Bätterkinden, all of Switzerland

[73] Assignee: Maschinenfabrik WIFAG, Bern, Switzerland

[21] Appl. No.: 772,592

[22] Filed: Oct. 4, 1991

Related U.S. Application Data

[63] Continuation of Ser. No. 385,238, Jul. 25, 1989, abandoned.

[30] Foreign Application Priority Data

Jul. 27, 1988 [DE] Fed. Rep. of Germany ..... 3825517

[51] Int. Cl.[5] ..... B41F 31/32; B41F 33/16

[52] U.S. Cl. ..... 101/148; 101/352

[58] Field of Search ..... 101/350, 349, 352, 351, 101/247, 148, DIG. 32, 348, 206-209; 118/256, 258

[56] References Cited

FOREIGN PATENT DOCUMENTS 2024457 1/1980 Fed. Rep. of Germany .

2942007 4/1981 Fed. Rep. of Germany ..... 101/352

*Primary Examiner*—J. Reed Fisher

*Attorney, Agent, or Firm*—McGlew & Tuttle

[57] ABSTRACT

The present invention describes a device for moving rollers and in particular rollers of a printing press in two independent directions. Movement in each direction is independent of movement in the other direction. The roller has trunnions which are mounted in roller locks. The roller locks are then mounted on a frame of the printing press. Mechanisms inside the roller lock position the roller lock in one direction with respect to the frame and other mechanisms inside the roller lock position the roller in another direction with respect to the roller lock. This mechanisms are independently controlled and movement of one mechanism is independent of the movement of the other mechanism. By independently controlling these mechanisms the roller can be engaged, disengaged and adjusted with respect to the frame or any components mounted on the frame.

22 Claims, 9 Drawing Sheets

DEVICE TO ENGAGE, DISENGAGE AND ADJUST THE INKING ROLLERS OR WETTING ROLLERS OF A PRINTING PRESS

This is a file wrapper continuation application of application Ser. No. 07/385,238, filed Jul. 25, 1989, now abandoned.

FIELD OF THE INVENTION

The present invention pertains to a device to engage, disengage and adjust a roller via a first adjusting element in relation to a first cylinder supported in a stationary position by a frame of a machine, and via a second adjusting element in relation to a second cylinder supported in a stationary position by the frame of the machine, or in relation to the stereo cylinder of a printing press.

BACKGROUND OF THE INVENTION

Such devices are known and a preferred embodiment is characterized in that the roller to be adjusted is swivel mounted between two rocking levers, which pivot around the axis of a first stationary cylinder. On pivoting, the roller is moved away relative to a second, stationary roller, which may be a second cylinder or a stereo cylinder. This pivoting motion is occasioned by pneumatically actuated cylinders. Even during the pivoting process of the roller around the first stationary cylinder, the roller remains continuously in contact with the first cylinder. To facilitate adjustment of the position of the roller, mechanical setting means have been arranged on the rocking levers, by means of which an adjustment of the roller can be made in a radial direction relative to the first cylinder.

Mechanically adjustable stops are necessary to set the roller relative to the second stationary cylinder, which takes place via the pivoting motion of the rocking levers. The rocking levers and, thus, the roller is pressed against these stops by the pneumatic cylinders.

Because it is necessary that the pivoting mechanisms can be adjusted external to the printing press, expensive mechanical devices are necessary, in particular to adjust the stationary stops.

During printing it may well be necessary to reset the diagonal register by adjusting the stereo cylinder. So that the roller which comes in contact with the stereo cylinder via the rocking levers which are pressed against the stops, do not also have to be reset with each diagonal register adjustment of the stereo cylinder, the inherently stationary stops are mounted on mechanical devices which cause the roller to follow the diagonal register adjustment of the stereo cylinder. These mechanical devices are very complicated and have specific space requirements.

Because the roller is mounted on rocking levers which pivot around a first cylinder, it is indeed possible to move the roller away from a second cylinder or from the stereo cylinder, i.e., to pivot them away. The roller remains, however, continuously in contact with the first cylinder, which is a disadvantage, for example, in the case of so-called paper winders which extend into the inking mechanism, during the replacement of such rollers, or when adjusting the such rollers relative to the two neighboring rollers.

With such inking or wetting systems it is not possible through the adjusting units, to automatically eliminate external influences, such as thermal dilation, which could change the original setting of the such rollers. Such resetting must be done manually and reversed, as well, manually. Such changes in the original settings of the such rollers through external influences during production can negatively influence the print quality of the print products.

An attempt was also made to press the roller, which is mounted on rocking levers, and adjusted by pneumatic cylinders, directly against the second cylinder or the stereo cylinder, by eliminating the stops. By changing the air pressure in the pneumatic cylinders, various degrees of contact pressure should be attained between the respective rollers. It became evident, however, that in this process the entire system becomes too unstable and that this can produce roller vibrations.

SUMMARY AND OBJECTS OF THE INVENTION

The purpose of the present invention is to create a simple, user-friendly way to set such rollers as inking or wetting rollers, which will make possible remote control and reporting of position in at least one direction. Also the optimal adjustment of inking or wetting rollers, so that such rollers can be altered to adapt to different operating conditions.

According to the present invention, this problem is solved by the provision of a device to engage and disengage and adjust an inking roller or wetting roller via a first adjusting member with respect to a first cylinder. The first cylinder is supported in a stationary position by the frame of the printing machine. A second adjusting element is provided for a second cylinder. The second cylinder is also supported in the frame of the machine. The adjustment may also take place for inking or wetting rollers in contact with the stereo cylinder of the printing press. At least one of the adjusting elements is actuated by an electrically-regulated final control element. The final control element is connected to a stored program controller which provides information to, and regulation of, the final control element. A position pick-up is attached to the electrically regulated final control element. The position pick-up emits an electrical signal which is dependent upon the position of the final control element. The electrical signal may be fed to the stored program controller.

Inking or wetting rollers equipped with such adjustment devices render possible the remote-controlled adjustment of the inking and wetting rollers possible relative to the stationary cylinders or stereo cylinders.

An advantageous embodiment of the present invention provides the design of the respective final control element as a spindle which is rotary-mounted in the housing of the roller lock and is provided with a thread. By rotating the spindle via a direct current motor and the proper gear drive, the inking or wetting rollers, which is engaged into the trunnions of which the spindle, can be very easily adjusted.

Another advantageous embodiment of the present invention provides for the attachment of the housing of the roller lock to a rocking lever. An end of the rocking lever adjacent the roller lock may be pivoted around the axis of the stationary cylinder. The adjustment of the inking or wetting roller relative to this stationary cylinder is accomplished in a radial direction. The adjustment of the inking or wetting roller relative to a second stationary cylinder is accomplished by pivoting the rocking lever around the axis of the first, stationary cylinder. The adjustment of the rocking lever is accomplished by another final control element, which is likewise designed in the form of a spindle and onto which a guide lever is rotary-mounted, the other end of which is swivel-mounted on the frame of the machine. Hereby, the inking or wetting roller can be adjusted relative to the stationary, second cylinder, without introducing a change of the position of the roller with respect to the position of the first cylinder. The position of the inking or wetting roller is recorded via a potentiometer, which is a feature of every final control element, in the stored-program controller.

Another advantageous embodiment of the present invention provides for the stationary mounting of the roller lock on the frame of the machine. In this roller lock two final control elements are mounted in the form of spindles which are advantageously positioned essentially perpendicular to each other and which can position the inking or wetting rollers at any given location within the adjustment range. In order to simplify the control of the adjustment process as much as possible, one of the two spindles, which are driven by direct current motors, is mounted, for all practical purposes, tangentially to one of the two stationary cylinders or the stereo cylinder. By adjusting the inking or wetting roller tangentially to the stationary cylinder, the position relative to this stationary roller changes only slightly within a certain range.

It is conceivable that the position pickup is designed as a pressure pickup which emits a measured value, by which the contact pressure of the inking or wetting roller on the stationary cylinder or on the stereo cylinder can be determined. By entering a predetermined contact pressure into a stored-program controller, the position of the inking or wetting roller relative to the corresponding stationary cylinder can be automatically regulated. Changes in the contract pressure of the inking or wetting roller relative to the stationary cylinder, which can occur in the course of production, can be hereby avoided. This would then contribute to maintaining the print quality of a rather long production phase.

A total disengagement of the inking or wetting rollers from the two stationary cylinders with which they can come in contact, has particular advantages, if, for example, a so-called paper winder is supplied with the printing press, which extends into the inking mechanism. Elimination of disturbances is greatly facilitated with an inking or wetting rollers that can be completely disengaged, and whereby the original position of the inking or wetting roller can again be immediately regained on continuation of production through the storage of position values in the stored-program controller.

The replacement of the inking or wetting rollers is also much easier when the two neighboring rollers are completely disengaged, because reengagement can then be accomplished automatically.

To initially adjust the inking or wetting roller relative the neighboring, stationary cylinder the inking roller is initially inked, in order to then achieve the optimum position by measuring the print line which develops upon contact with the respective stationary roller. This adjusting is simpler if the inking roller can be completely moved away from the two neighboring rollers.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS In the drawings.

Figure 4:
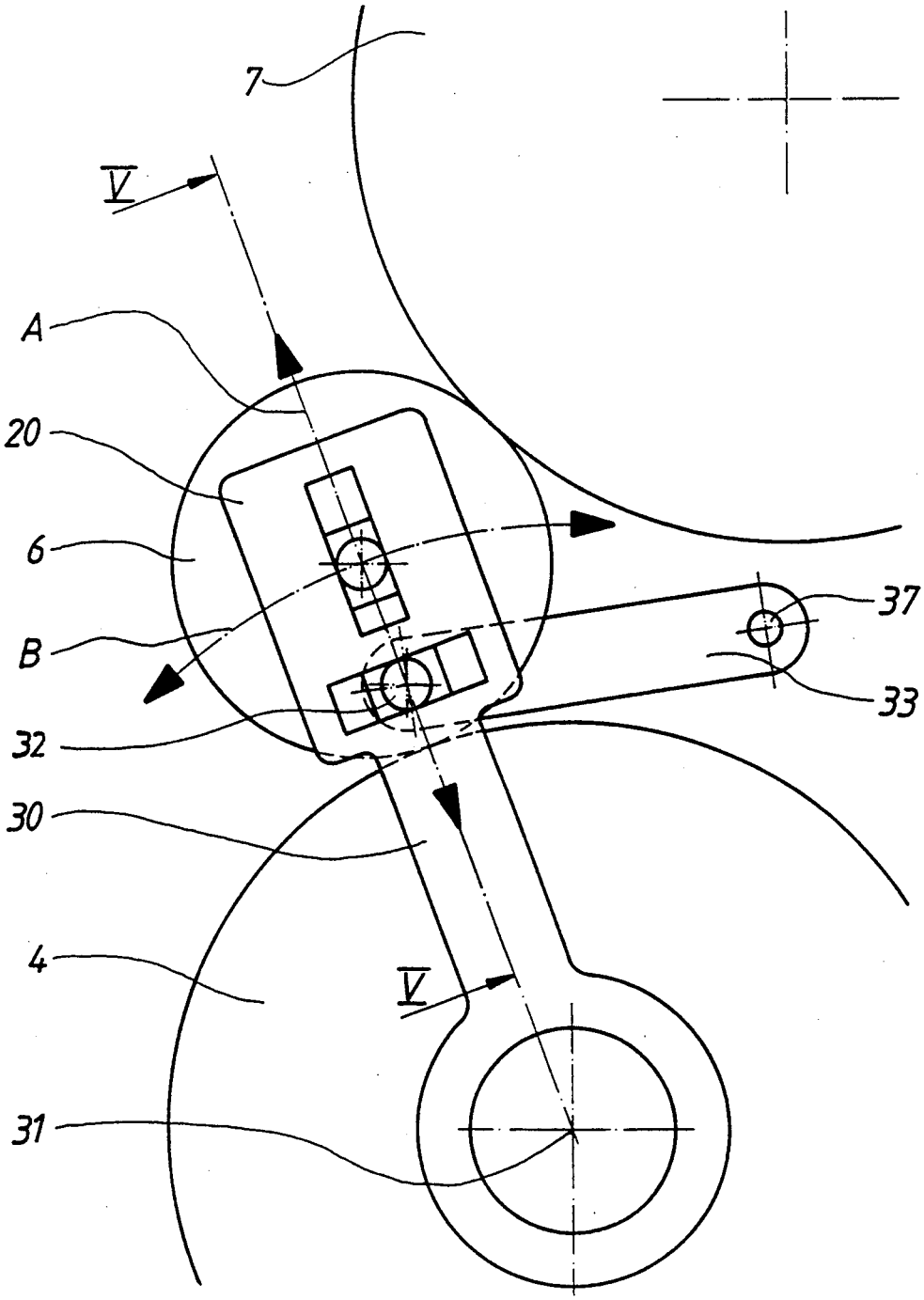
Figure 5:
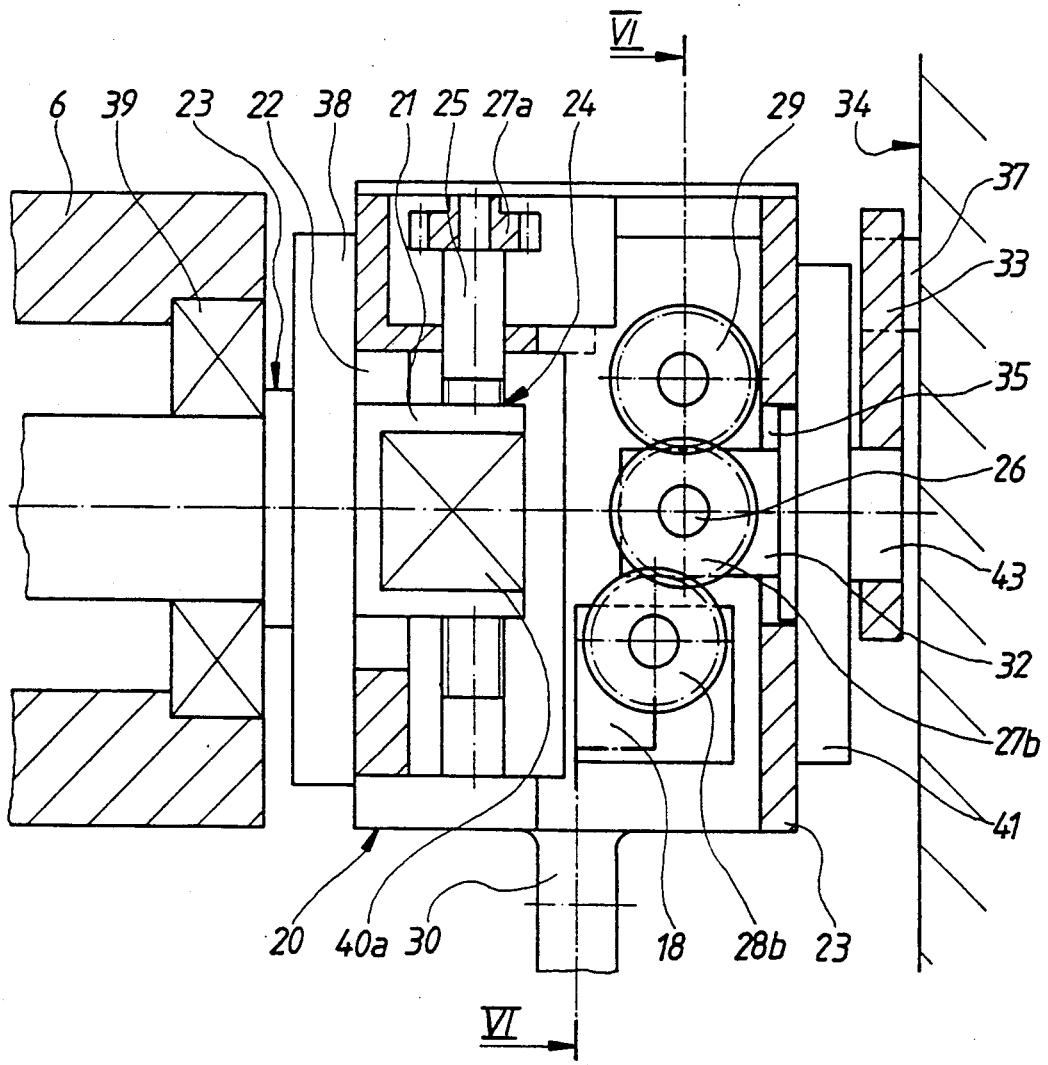
Figure 6:
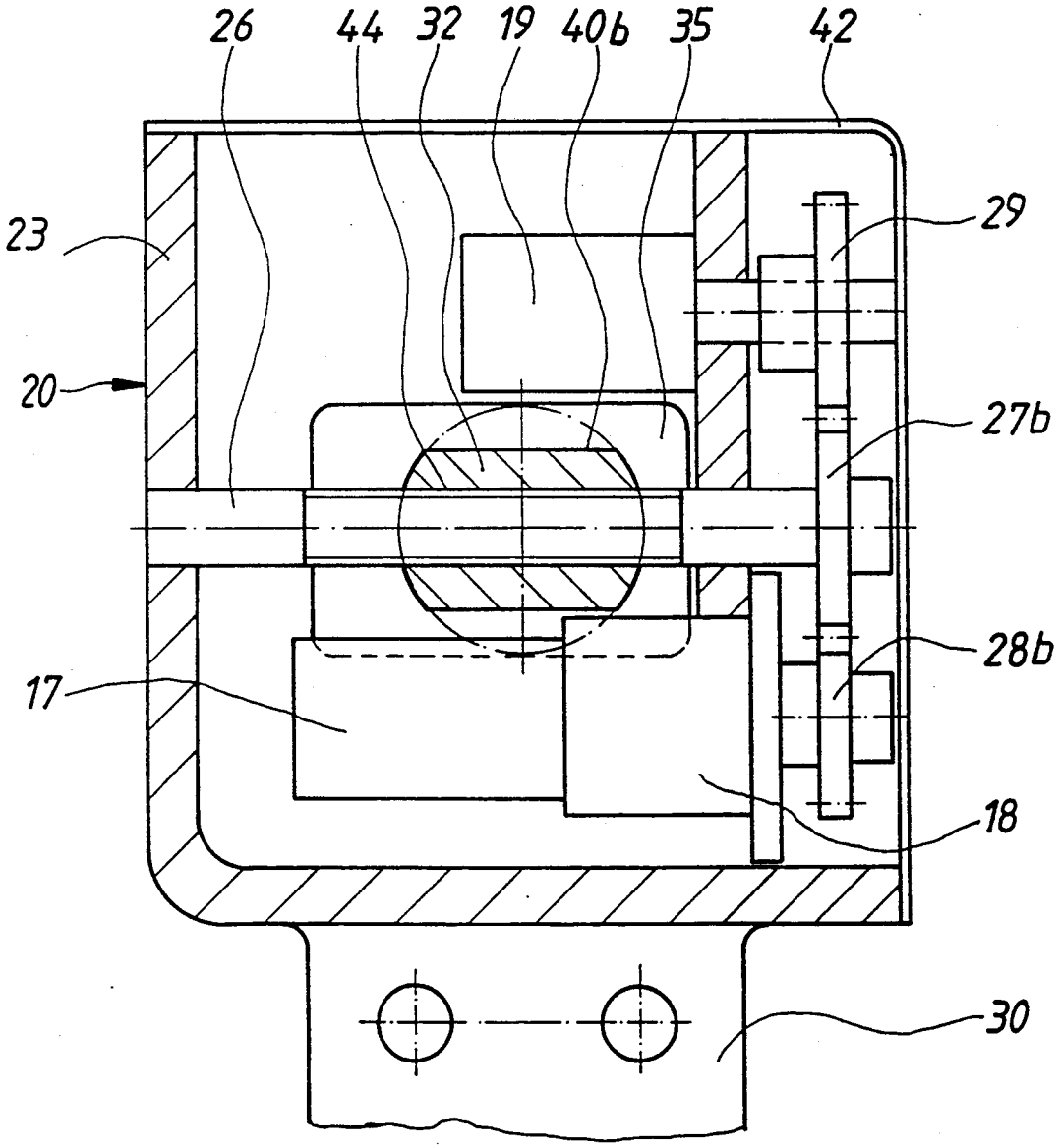
Figure 7:
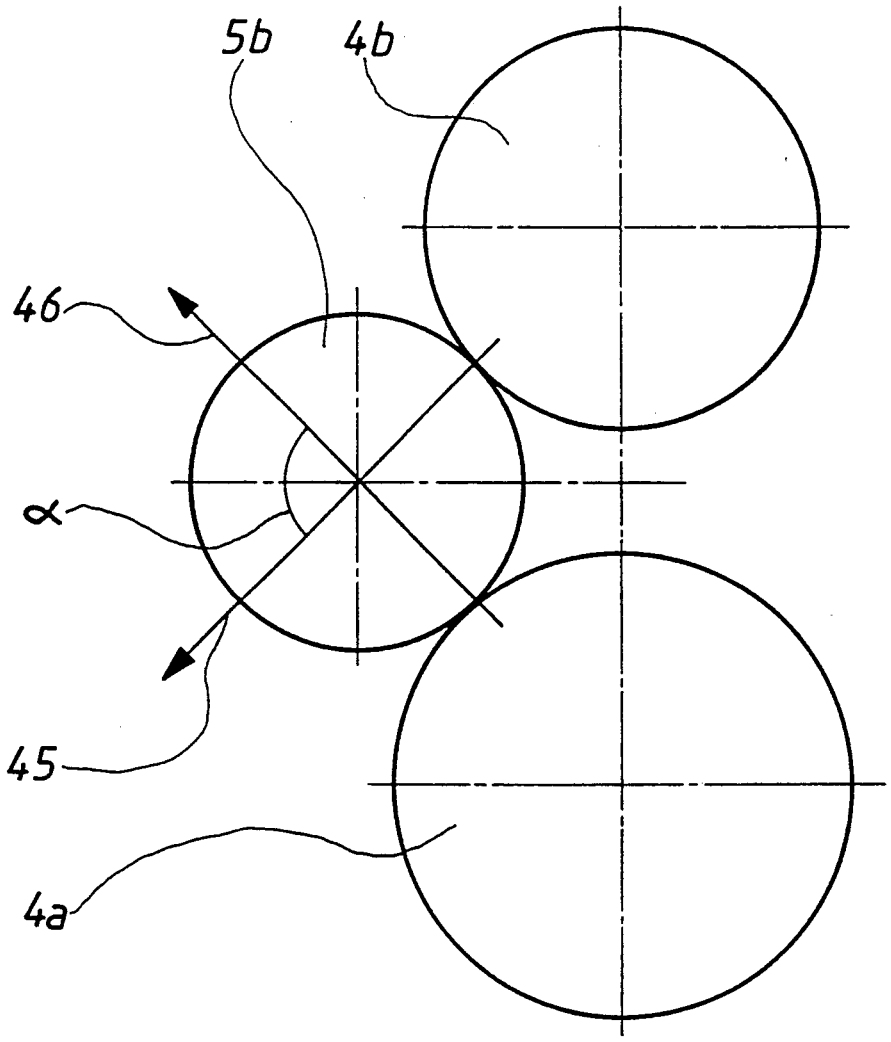
Figure 8:
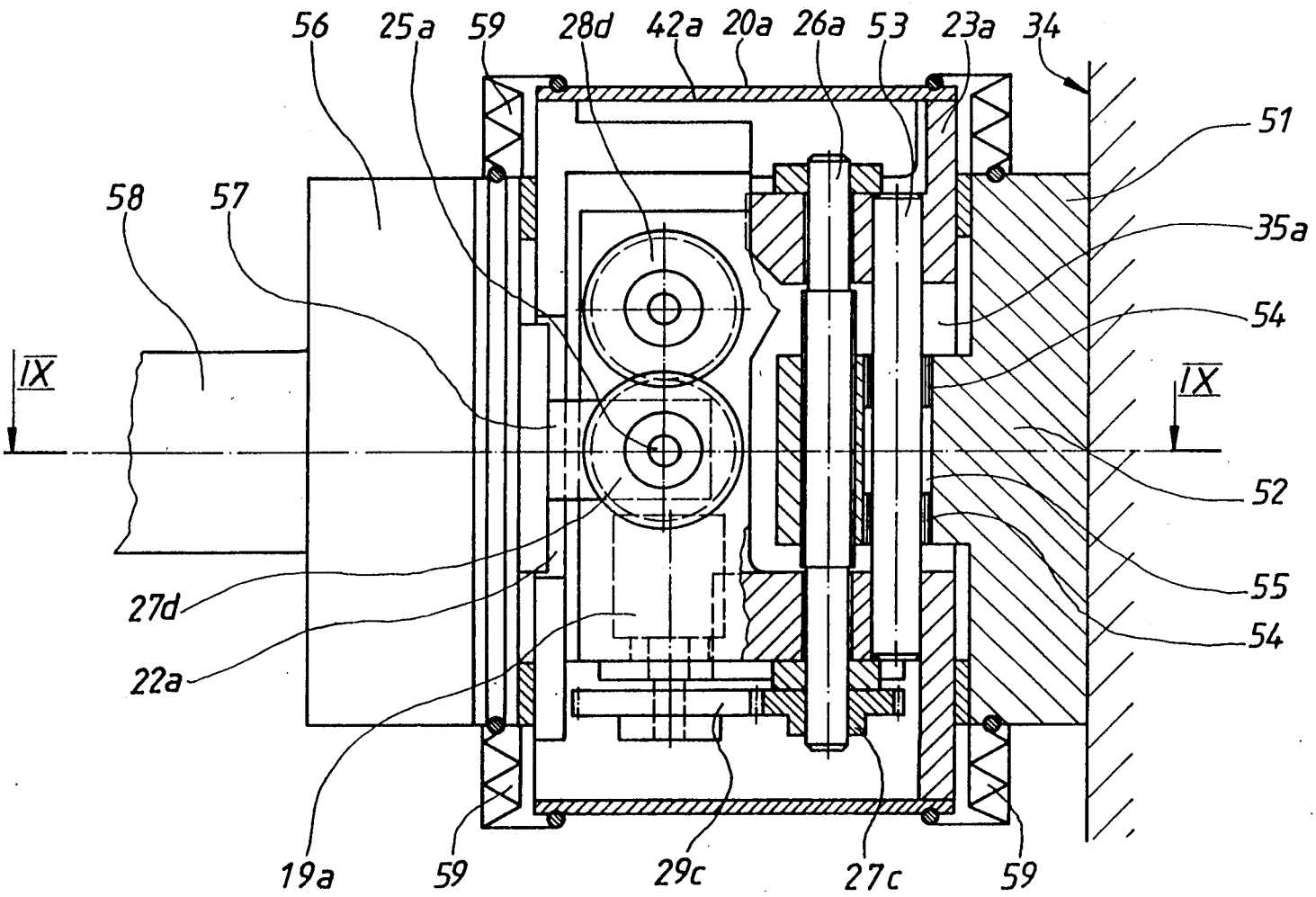
Figure 9:
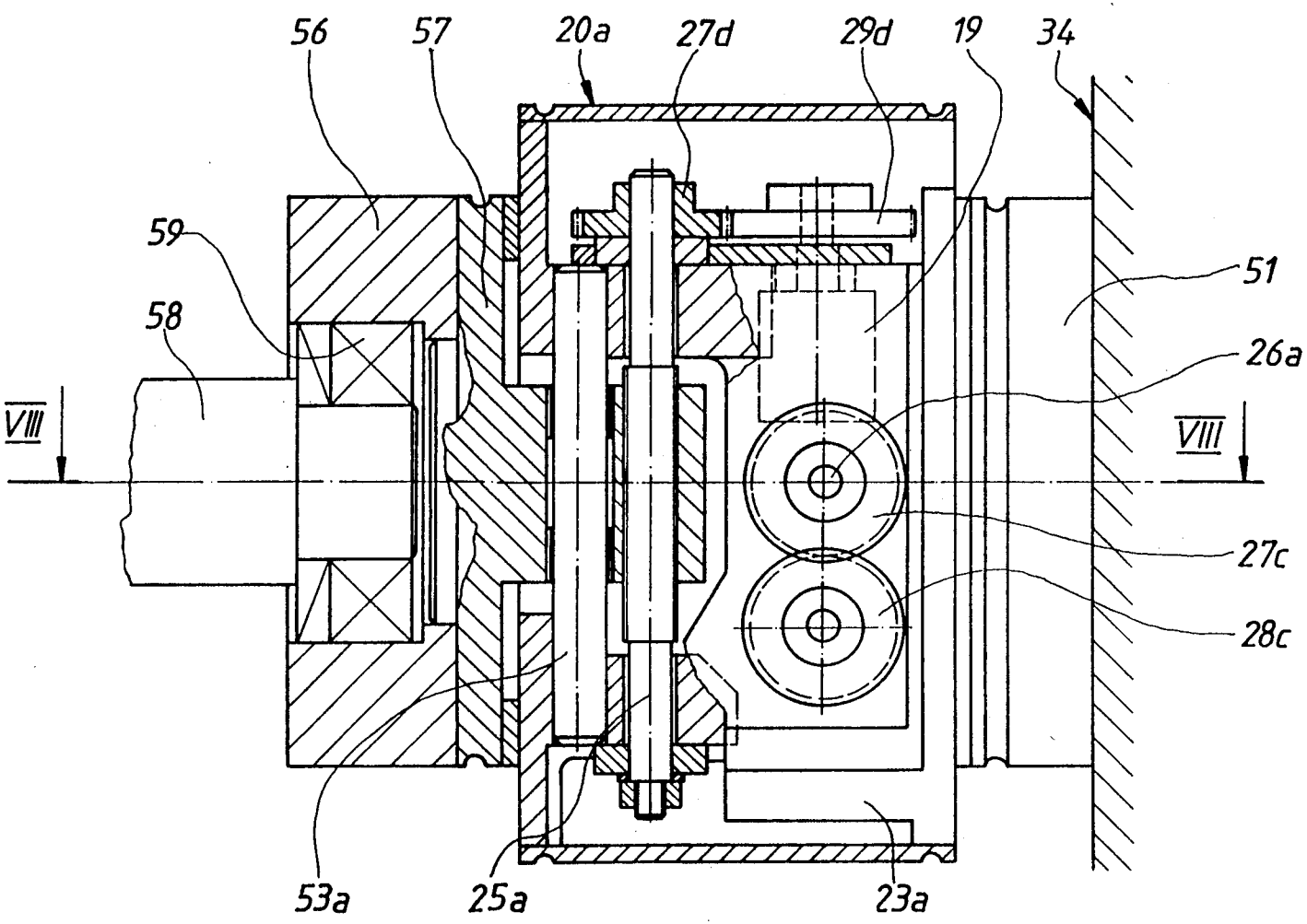

FIG. 4 schematically shows the layout of the roller lock on a rocking lever;

FIG. 5 is a cross-section along line V—V through the roller lock according to FIG. 4;

FIG. 6 is a cross-section along line VI—VI through the roller lock according to FIG. 5;

FIG. 7 is a schematic drawing of a roller lock mounted on the frame of a machine;

FIG. 8 is a cross-section along line VII—VII through the roller lock according to FIG. 7;

FIG. 9 is a cross-section along line IX—IX through the roller lock according to FIG. 7.

DESCRIPTION OF THE PREFERRED EMBODIMENT

Figure 1:
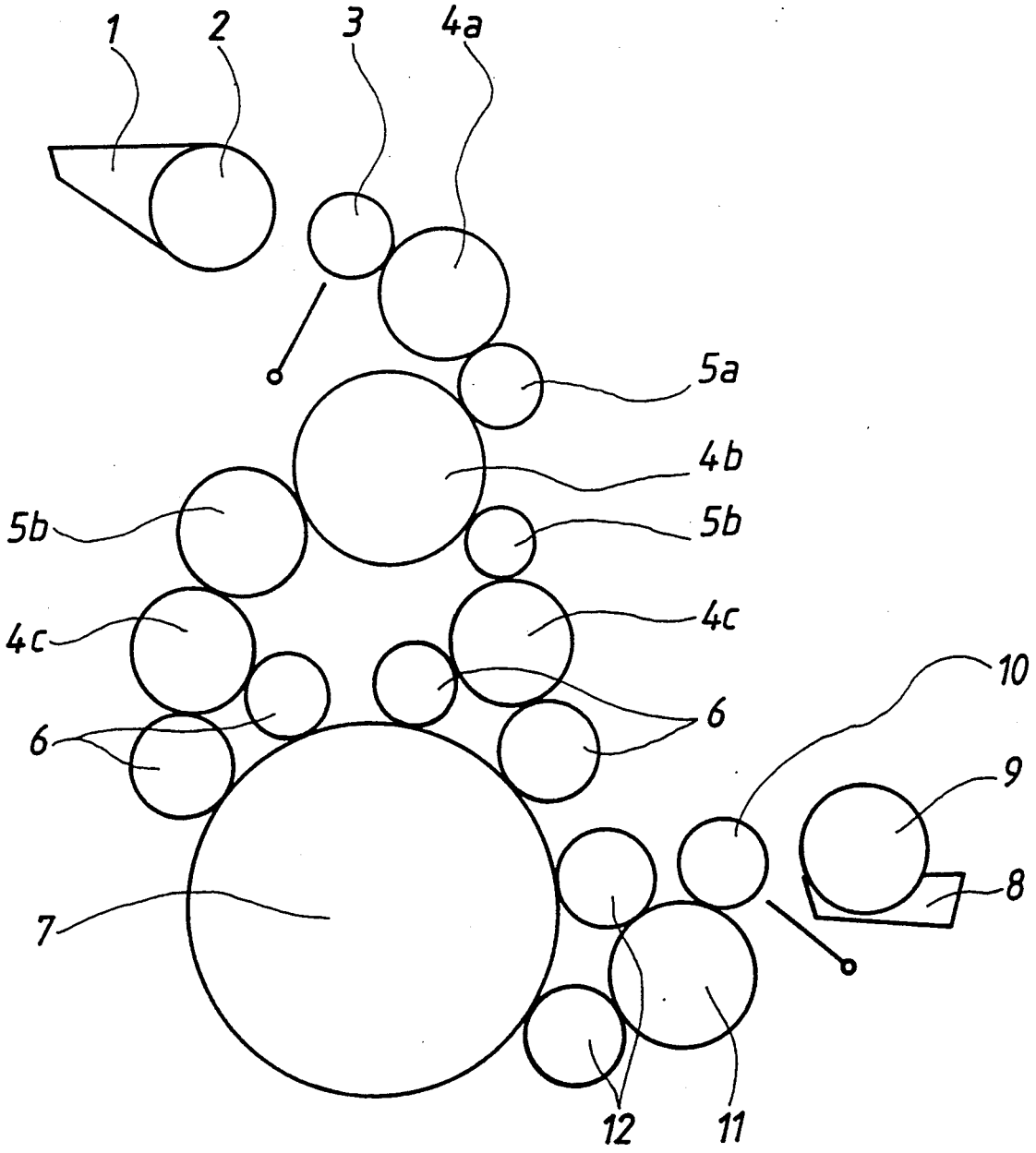
FIG. 1 is a schematic representation of the printing mechanism of a printing press according to the invention.

FIG. 1 is the schematic drawing of a printing mechanism for a printing press. Here, duct roller 2 is provided with an ink layer from the ink located in inkwell 1. The vibrating roller 3 transfers ink from duct roller 2 via a pendular motion to the first, stationary cylinder 4*a*. A first transfer roller 5*a* transfers the ink to a second cylinder 4*b*. From here the ink works its way over second transfer rollers 5*b* to third, stationary cylinders 4*c* which, in turn, transfer the ink to inking rollers 6. In a similar fashion, the wetting agent travels from wetting agent well 8 to wetting agent well roller 9 and via vibrating roller 10 to stationary cylinder 11, from where the wetting agent is transferred via the application rollers 12 to the plate of stereo cylinder 7. At least during one production cycle, stereo cylinder 7 as well as cylinders 4*a*–4*c* and 11 are, for all practical purposes, stationary in the printing frame. Transfer rollers 5*a* and 5*b* as well as application rollers 6 and 12 are equipped with adjustment mechanisms of the present invention. By means of the adjustment mechanisms, the positions of rollers 5*a*, 5*b*, 6 and 12 relative to the stationary rollers with which they are in contact, can be changed.

Figure 2:
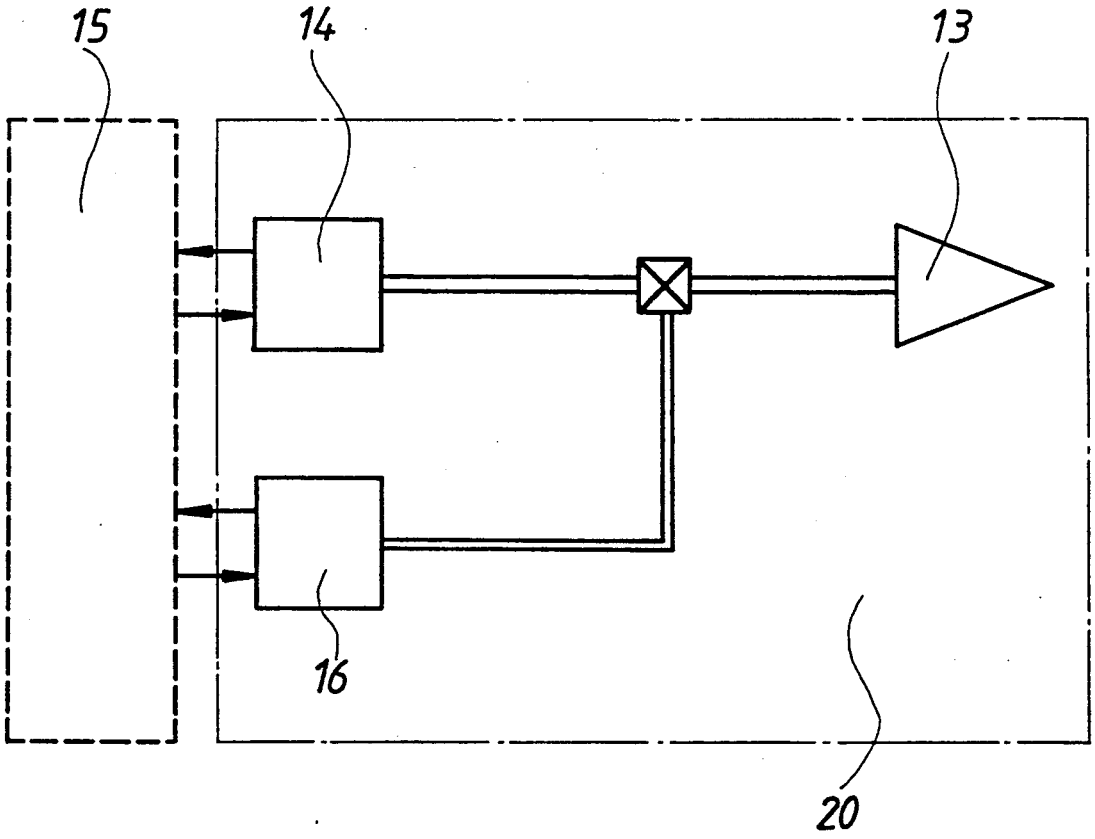
FIG. 2 is a wiring diagram of a control device according to the invention.

In the wiring diagram, drawn in FIG. 2, the electrically driven final control element 14 receives adjustment commands from the stored-program controller 15 and feeds these in suitable form on to adjusting element 13, which is responsible for the mechanical adjustment. A position pickup 16 is assigned to final control element 14 which reports back the respective position or pressure values to the stored-program controller 15. Electrically driven final control element 14 as well as adjusting element 13 and position pickup 16, assigned to final control element 14, are mounted in roller lock 20 of the adjustable inking or wetting roller.

Figure 3:
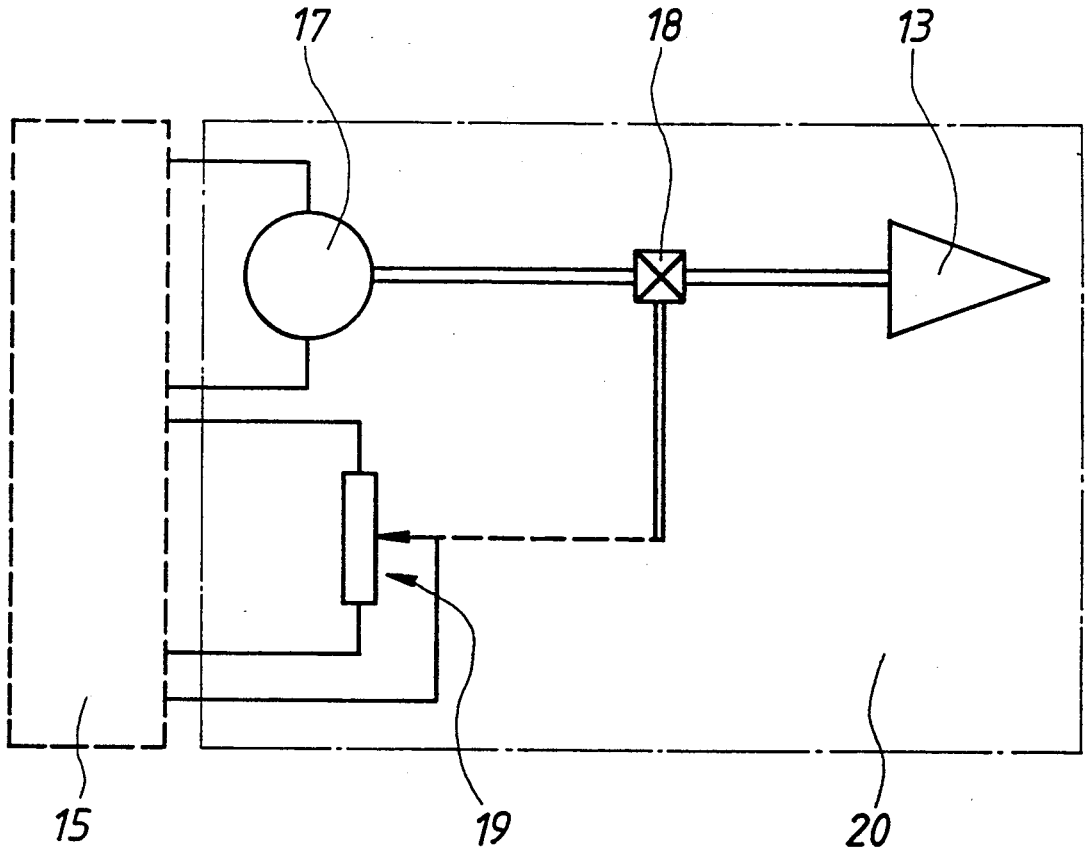
FIG. 3 is a wiring diagram of a control device with direct current motor and potentiometer.

FIG. 3 shows the electrically driven final control element 14 designed as a direct current motor 17, which can actuate the adjusting element 13 via gear drive 18. The movement and thus the position of adjusting element 13 is transferred by gear drive 18 to potentiometer 19, which reports back the position of adjusting element 13 to the stored-program-controller 15 in the form of signals. Direct current motor 17, gear drive 18, adjusting element 13 as well as potentiometer 29 are mounted in roller lock 20.

In FIG. 4, a stationary cylinder 4, an application roller 6 and a stereo cylinder 7 are schematically shown. Rocking lever 30 is rotary-mounted around rotation axis 31 of cylinder 4. Roller lock 20, in which application roller 6 is rotary-mounted, is stationarily attached to rocking lever 30. Into roller lock 20 bolt 32 extends, which is attached to guide lever 33. Guide lever 33 is hinged to the frame of the machine via hinge pin 37. The adjustment of application roller 6 relative to cylinder 4 is accomplished by a radial displacement (Arrow A) with respect to cylinder 4. The adjustment of application roller 6 relative to the stereo cylinder is accomplished by swivelling rocking lever 30 (Arrow B) relative to guide lever 33.

With such a mechanism, preferably the position of application roller 6 relative to cylinder 4 is first set. This should be done when application roller 6 and, thus, rocking lever 30 is in the position away from stereo cylinder 7. Once the position of application roller 6 relative to cylinder 4 is set, then by swivelling rocking lever 30 in the direction of stereo cylinder 7, the position of application roller 6 relative to stero cylinder 7 can be set. In this process, the setting of application roller 6 relative to cylinder 4 remains unchanged.

The mechanism, drawn in FIG. 4, to set application roller 6 relative to stero cylinder 7 or cylinder 4 is also applicable to the transfer rollers 5, according to which the setting of these transfer rollers 5 is done relative to two cylinders 4.

In FIG. 5, roller lock 20 is attached to rocking lever 30, which can be pivoted around the rotational axis 31 of cylinder 4. Roller lock 20 has a housing 23. In this housing 23 a first recess 22 has been formed, into which the trunnion 21 of application roller 6 extends. Application roller 6 may be freely rotated via roller bearing 39 on the trunnion. Trunnion 21 has been provided with a flange 38, which covers the recess 22 of the housing 23. The end of trunnion 21 which extends into housing 23 of roller lock 20 is provided with a threaded hole 24. Spindle 25 is screwed into the threaded hole 24. Spindle 25 is rotary-mounted in housing 23, but secured against displacement. Cogwheel 27 is non-rotatably attached to spindle 25. The end of trunnion 21 which extends into housing 23 of roller lock 20 has been provided with bevellings 40*a*.

An additional spindle 26 is mounted in housing 23 of roller lock 21 approximately perpendicular to spindle 25. Spindle 26 is rotary-mounted as well and secured against displacement. Spindle 26 has been screwed into a corresponding threaded hole bolt 32. Bolt 32 passes through housing 23 of roller lock 20 through recess 35. Flange 41, mounted on bolt 32, covers recess 35 of housing 23 of roller lock 20. Guide lever 33 is rotary-mounted on hinge pin 43 of bolt 32. The other end of guide lever 33 is likewise rotary-mounted on hinge pin 37, which is stationary-mounted to the frame of the machine 34.

Cogwheel 27*b* has been mounted and secured against rotation on spindle 26. Cogwheel 27*b* meshes with cogwheel 29, which is attached to the potentiometer, not shown. Cogwheel 28*b* likewise engages cogwheel 27*b*. Cogwheel 28*b* is mounted non-rotatably on the output shaft of gear drive 18. Gear drive 18 is flange-mounted to direct current motor 27 (see FIG. 6).

FIG. 6 shows spindle 26, which is rotary-mounted in housing 23 of roller lock 20 and secured against displacement. Spindle 26 is screwed into threaded hole 44 of bolt 32. Bolt 32, which is provided with bevelings 40*b*, extends through recess 35 of housing 23 into roller lock 20. Roller lock 20, in turn, rests upon rocking lever 30. Cogwheel 27*b* of spindle 26 is engaged, on the one hand, with cogwheel 29, which has been mounted non-rotatably on the shaft of potentiometer 19 and, on the other hand, with cogwheel 28*b*, which is mounted on the output shaft of gear drive 18, and gear drive 18 is flange-mounted to direct current motor 17. All movable parts of roller lock 20 are completely sealed off, on the one hand, by housing 23, and, on the other hand, by the covers 38 and 41, which keep out dirt.

Instead of mounting roller lock 20 on rocking lever 30, is also possible to stationarily attach a part of roller lock 20 to the frame of machine 34.

In FIG. 7, two cylinders 4*a*, 4*b* are shown, with intervening transfer roller 5*b* between them. The adjustment of transfer roller 5*b* is done rectilinearly. The two arrows 45 and 46, which reflect the directions of the corresponding spindles, show the directions in which the adjustment may be made. The angle between the two setting directions 45 and 46 is on the order of 90°. Advantageously, one of the setting directions 45, or 46 is selected so that, for all practical purposes, it is tangential to the corresponding cylinder 4*a* or 4*b*. If, for example, setting direction 45 is tangential to cylinder 4*a*, then transfer roller 5*b* can be minimally adjusted relative to cylinder 4*b*, without noticeably changing the adjustment of transfer roller 5*b* relative to cylinder 4.

In FIG. 8, bolt 52, provided with socket 51, is stationary-mounted to the frame of the machine 34. Bolt 52 extends through recess 35*a* into housing 23*a* of roller lock 20*a*. Via a threaded hole provided in bolt 52, spindle 26*a* is screwed. Spindle 26*a* is rotary-mounted in housing 23*a* and secured against displacement. Parallel to spindle 26*a* in housing 23*a*, guide bolt 53 had been introduced, which is positioned in hole 55 of bolt 52. Hole 55 is equipped with guides 54. Guide bolt 53 serves to take up the forces which develop and, thereby relieves spindle 26*a*. Spindle 26*a* is provide with cogwheel 27*c*, which, in turn, meshes with the corresponding cogwheel of the drive and the potentiometer.

The other spindle 25*a* is mounted, for all practical purposes, perpendicularly to spindle 26*a*. Spindle 25*a* is positioned in a correspondingly arranged threaded hole of pivot pin 57, which is equipped with flange 56. Pivot pin 57 extends through recess 22*a* into housing 23*a* of roller lock 20*a*. Trunnion 58 of the adjustable roller is rotary-mounted in flange 56. Housing 23*a* of roller lock 20*a* is completely closed in by cover 42*a* and the appropriately arranged rubber bellows 59.

As is apparent from FIG. 9, trunnion 58 is rotary-mounted in flange 56 via roller bearings. Pivot pin 57 provided with a threaded hole extends, for its part, into roller lock 20*a*. Into the threaded hole spindle 25*a* has been screwed. Spindle 25*a* is equipped with cogwheel 27*d*, which, in turn, meshes with the corresponding cogwheels of the drive and potentiometer 19. Here, as well, guide bolt 53*a* takes up the bending forces which develop.

Spindles 25, 26 can be manually adjusted to set adjustable rollers 5, 6 or 12 to the point where adjustable rollers 5, 6, 12 contact the corresponding, stationary rollers. This position can be stored in the stored-program controller 15. At the same time, the value of the diameter of the adjustable roller can also be assigned to this position. Other necessary positions for various production formats are obtained from this basic position of the adjustable roller. The relative position values may, in turn, be stored in the stored-program controller 15. Thus, it is possible on the basis of a known production format to set all adjustable rollers to correspond to this production format.

In the course of production and manufacture of a large number of identical print products, it is possible that external conditions will change, e.g. through a change of temperature. This could mean that the positioning of the inking or wetting rollers relative to neighboring, stationary rollers, is no longer optimum. The position of the inking or wetting rollers relative to neighboring, stationary rollers may be corrected, for example, on the basis of temperature monitoring according to a predetermined program in the stored-program controller. Thereby, uniform print quality is guaranteed for the duration of production.

Because the basic position is dependent upon the diameter of the adjustable roller, and the corresponding diameter of the adjustable roller is assigned as a parameter to this basic position, the exact diameter of the new roller can be entered when a roller is changed. The correspondingly programmed, stored-program controller 15 predetermines the basic position for this new roller. Resetting of the newly replaced roller is, therefore, not necessary. All the previously entered, different positions of the adjustable roller for various production conditions are also predetermined by stored-program controller 15, in accordance with the available program.

It is also conceivable that other adjustment mechanisms could be used, for example, pneumatically-driven ones, in place of the spindles and their corresponding drive motors, which are used in the embodiment described.

While specific embodiments of the invention have been shown and described in detail to illustrate the application of the principles of the invention, it will be understood that the invention may be embodied otherwise without departing from such principles.

What is claimed is:

1. A device for positioning a transfer roller, the device comprising:

a frame;

a first stationary roller mounted on said frame;

a second stationary roller mounted on said frame;

a roller lock having means for mounting said roller lock displaceably on said frame in a first direction substantially tangential to the first stationary roller;

a first adjustment means for moving said roller lock in said first direction;

a roller lock position means for measuring position of said roller lock with respect to said frame;

a trunnion rotatably mounted to, and along the axis of, the transfer roller and having means for mounting said trunnion displaceably on said roller lock in a second direction substantially tangential to the second stationary roller and independent of said first direction;

a second adjustment means on said roller lock for moving said trunnion in said second direction independent of said first adjustment means moving said roller lock;

trunnion position sensing means for measuring position of said trunnion with respect to said roller lock; and programmable control means for independently moving the transfer roller in said first and second direction by independently controlling said first and second adjustment means and for receiving predetermined position information from external sources, and actual position information from said roller lock and trunnion position sensing means, said programmable control means using said position information to control said first and second adjustment means.

2. A device in accordance with claim 1, further comprising:

a rocking lever attached to the roller lock on one end and rotatably attached, about the axis of the first stationary roller, to said frame;

a guide lever being attached on one end to said frame and on another end to said first adjustment means.

3. A device in accordance with claim 1, further comprising:

pressure sensor means for measuring pressure between said transfer roller and one of said first and second stationary rollers; and said programmable control means also receiving pressure information from said pressure sensor means and using said pressure information to control said first and second adjustment means.

4. A device for adjusting the position of a roller, the device comprising:

a frame;

a trunnion rotatably mounted to, and along an axis of, the roller;

a roller lock having means for mounting said roller lock displaceably on said frame in a first direction relative to said frame, said trunnion having means for mounting said trunnion displaceably on said roller lock in a second direction independent of said first direction;

a first adjustment means on said roller lock for moving said roller lock in said first direction;

a second adjustment means on said roller lock for moving said trunnion in said second direction independent of said first adjusting means moving said roller lock; and programmable control means for independently moving the roller in said first and second directions by independently controlling said first and second adjustment means.

5. A device in accordance with claim 4, further comprising: an additional trunnion rotatably mounted on and along the axis of the roller opposite said trunnion;

an additional roller lock having means for mounting said additional roller lock displaceably in said first direction to said frame, said additional roller lock also having means for mounting said additional roller lock displaceably in said second direction to said additional trunnion;

an additional first adjustment means for moving said additional roller lock in said first direction;

an additional roller lock position means for measuring position of said additional roller lock with respect to said frame;

an additional second adjustment means on said additional roller lock for moving said additional trunnion in said second direction;

an additional trunnion sensing means for measuring position of said additional trunnion with respect to said additional roller lock; and said programmable control means also receiving additional position information from said additional roller lock and trunnion position sensing means, and using said position information with said additional position information to also control said additional first and second adjustment means.

6. A device in accordance with claim 4, wherein:

one of said first and second adjustment means uses pneumatics to cause said movement.

7. A device in accordance with claim 4, wherein:

one of said first and second adjustment means uses an electric motor to cause said movement.

8. A device in accordance with claim 7, wherein:

said trunnion defines a first threaded bore in said second direction;

a first threaded shaft is rotatably mounted in said roller lock and threadally engages said first threaded bore; and said electric motor rotates said first threaded shaft under said control of said programmable control means.

9. A device in accordance with claim 8, wherein:

said frame defines a second threaded bore in said first direction;

a second threaded shaft is rotatably mounted in said roller lock and threadally engages said second threaded bore; and an additional electric motor rotates said second threaded shaft under said control of said programmable control means.

10. A device in accordance with claim 9, further comprising:

a first guide bolt;

said trunnion defining a first guide bore for receiving said first guide bolt;

a second guide bolt mounted substantially parallel to said second threaded shaft; and said frame defining a second guide bore for receiving said second guide bolt.

11. A device in accordance with claim 4, further comprising:

a roller lock position means for measuring position of said roller lock with respect to said frame;

trunnion position sensing means for measuring position of said trunnion with respect to said roller lock; and said programmable control means also receiving predetermined position information from external sources, and actual position information from said roller lock and trunnion position sensing means, said programmable control means using said position information in said controlling of said first and second adjustment means.

12. A device in accordance with claim 11, wherein:

one of said roller lock position means and said trunnion position sensing means is a potentiometer.

13. A device in accordance with claim 4, wherein:

said second direction is substantially perpendicular to both the axis of the roller and said first direction.

14. Device for engaging, disengaging, and adjusting a roller of a printing press, the device comprising:

a frame;

a first stationary cylinder mounted in said frame;

trunnions rotatably mounted on each end of the roller;

roller locks having means for mounting said roller locks displaceably on said trunnions, said roller locks also having means for mounting said roller locks displaceably on said frame;

first adjusting means in said roller locks for adjustment of the roller relative to said first stationary cylinder;

a second stationary cylinder mounted in said frame;

a second adjusting means in said roller locks for adjustment of the roller relative to said second stationary cylinder, said adjustment being independent of, and in an independent direction from, said first adjusting means adjusting the roller;

electrically controlled drives;

said first and second adjusting means are arranged in the form of first and second spindles, respectively, in said roller locks, said first spindle threadally engaging one of said trunnions, said second spindle threadally engaging said frame, said first and second spindles actuated via said electrically controlled drives;

programmable control means for independently moving the roller in independent directions by independently controlling said electrically controlled drives; and a potentiometer producing a signal dependent on the position of said electrically controlled drives and said signal being sent to said programmable control means.

15. Device in accordance with claim 14, wherein:

one of said roller locks define a first recess for receiving one of said trunnions;

one of said trunnions defines a threaded hole through which said first spindle is led;

said first and second spindles mounted rotatably and secured against displacement in said roller locks;

said second spindle rotatably mounted in one of said roller locks at an angle of substantially 90° relative to said first spindle.

16. Device in accordance with claim 15, further comprising:

first gears mounted nonrotatably on each of said first and second spindles;

gear mechanisms engaging with each of said first gears, said gear mechanisms are driven by said electrically controlled drives; and said electrically controlled drives are designed as d.c. motors.

17. Device in accordance with claim 16, further comprising:

second gears mounted nonrotatably to said potentiometer and engaging one of said first gears.

18. Device in accordance with claim 15, further comprising:

a rocker lever fastened at one end to one of said roller locks and said rocker lever hinged at another end to an axis of one of said first and second stationary cylinders and pivotable around said axis.

19. Device in accordance with claim 14, further comprising:

a guide lever hinged pivotably on one end to said press frame;

a bolt fastened on another end of said guide lever, said bolt extending into one of said roller locks and, defining a threaded hole through which said second spindle is led.

20. Device in accordance with claim 14, further comprising:

a frame bolt through which said second spindle is led and said frame bolt is rigidly connected to said press frame.

21. Device in accordance with claim 20, wherein:

said second spindle is arranged in a substantially tangential direction relative to said second stationary cylinder and said first spindle is arranged at a substantially right angles to said second spindle.

22. Device in accordance with claim 14, further comprising:

a pressure sensor means for measuring a pressure with which the roller is brought into contact with one of said stationary rollers, said pressure sensor means being used to regulate said first and second adjustment means.

* * * * *